US006457476B1

(12) United States Patent
Elmer et al.

(10) Patent No.: US 6,457,476 B1
(45) Date of Patent: Oct. 1, 2002

(54) APPLICATOR FOR APPLYING LIQUID PRODUCTS TO HAIR

(75) Inventors: Simon James Elmer, Twickenham; Shane David Meehan, Cashel, both of (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/767,349

(22) Filed: Jan. 23, 2001

(51) Int. Cl.[7] ..... A45D 24/22
(52) U.S. Cl. ..... 132/114; 132/901; 132/116
(58) Field of Search ..... 132/112, 113, 132/114, 115, 116, 161, 901

(56) References Cited

U.S. PATENT DOCUMENTS

| | | | | | |
|---|---|---|---|---|---|
| 724,178 | A | * | 3/1903 | Grant | 132/113 |
| 841,175 | A | * | 1/1907 | Phinney | 132/113 |
| 1,180,199 | A | * | 4/1916 | Smith | 132/113 |
| 1,533,416 | A | * | 4/1925 | Holchin | 132/113 |
| 2,031,774 | A | | 2/1936 | Helfrich et al. | |
| 2,259,931 | A | * | 10/1941 | Griffith | 132/116 |
| 2,607,064 | A | * | 8/1952 | Sullivan et al. | 132/901 |
| 3,457,928 | A | | 7/1969 | Kurshenoff | |
| 3,520,311 | A | | 7/1970 | Iesersek et al. | |
| 3,961,635 | A | * | 6/1976 | Miya | 132/113 |
| 4,605,026 | A | | 8/1986 | Nolin | |
| 4,913,172 | A | * | 4/1990 | Chou | 132/113 |
| 4,987,909 | A | | 1/1991 | Snyder | |
| 5,311,887 | A | | 5/1994 | Ramsey | |
| 5,339,839 | A | | 8/1994 | Forcelledo et al. | |
| 5,975,089 | A | | 11/1999 | Simon | |
| 6,047,703 | A | * | 4/2000 | Paglericcio et al. | 132/113 |

FOREIGN PATENT DOCUMENTS

| | | | |
|---|---|---|---|
| JP | 8-131235 | A | 5/1996 |
| JP | 8-196332 | A | 8/1996 |
| JP | 9-327325 | A | 12/1997 |
| JP | 9-327326 | A | 12/1997 |
| JP | 10-075815 | A | 3/1998 |
| JP | 11-155626 | A | 6/1999 |
| JP | 11-169223 | A | 6/1999 |
| JP | 11-290131 | A | 10/1999 |

* cited by examiner

*Primary Examiner*—Todd E. Manahan
(74) *Attorney, Agent, or Firm*—Andrew A. Paul; Jack L. Oney

(57) ABSTRACT

An applicator assembly for applying liquid product to the hair. The applicator assembly has an applicator that further base and multiple tines extending from the base. Opposite the tines, the base has a liquid distribution cavity. At least some of the tines have a tip at the end opposite the base, and may also have an enlarged fin section adjacent to the base. The enlarged fin sections extends to a shoulder portion located less than half way upward between the base and the tip of the tine. The tines may also have an aperature that allows fluid to be distributed from the cavity directly to the hair. The tip of the tine may be relatively flexible, while its enlarged fin section provides a more rigid lower portion.

47 Claims, 13 Drawing Sheets

APPLICATOR FOR APPLYING LIQUID PRODUCTS TO HAIR

FIELD OF THE INVENTION

The present invention relates to an applicator for applying liquid products, such as dye or coloring, to the hair. The applicator can be used in conjunction with a manually squeezed or aerosol propelled dispensing type container or other type dispensing devices.

DESCRIPTION OF THE PRIOR ART

A variety of devices for applying hair treatment products currently exist. Many such devices or applicator assemblies have applicators that include tines that are too narrow and have insufficient surface area to distribute product evenly throughout the hair. Other applicators have comb tines which are too large and too wide making it difficult to get the comb through the hair and also causing discomfort to the end user. Existing applicators also have difficulty in getting product to the hair roots because the upper section of the tines can be too large, thus not allowing the comb to penetrate the hair and get to the roots. Some applicators have too many tines or have tines which are positioned too close together. However, one commonality among all the current applicators is the mess suffered by the end users and their environment by product being dropped or "flicked" off of the device in use as a result of the problems associated with the shapes described above.

A desirable applicator would be one that evenly delivers product to the surface of the hair, the roots of the hair and the bulk of the hair. The surface of the hair is the hair that is most likely to be seen or that hair which is in plain view. Delivering product to the surface of the hair is critical to the consumer because it allows them to see what they have coated. The root of the hair is that length of the hair closest to the scalp and is normally up to about one inch from the scalp. Delivery of the product to the root of the hair is important aesthetically to the consumer. Lastly, the bulk of the hair is that area between the root and the surface. Product delivery to the bulk of the hair is important because the product acts as a lubricant when combed through the hair which adds to the comfort during application, and consistent coloration throughout the hair is preferred by the consumer.

SUMMARY OF THE INVENTION

In an exemplary embodiment of the invention, an applicator assembly has an applicator which comprises a base and a plurality of tines. The base of the applicator can be connected to an applicator housing by a skirt extending from the base. Typically, the applicator housing would connect to a manually squeezed or aerosol propelled dispensing type container or other type of liquid source or dispensing device. The plurality of tines extend outwardly on the opposite side of the base from the skirt. The tines also have a fin shaped bottom portion and a narrowed upper portion. The upper portion of the tine may have a lower aperture that is substantially at an intermediate point of the tine and/or a tip aperture adjacent to the distal end of the tine. The base may also have one or more apertures between adjacent tines. The base, tines and apertures of the applicator are designed to deliver even flow of product to the surface, root, and bulk of the consumer's hair. The tines may be partially flexible and at least some of the tines comprise a fluid pathway for delivery of product to the apertures.

Other advantages and novel features of the present invention will become apparent to those skilled in the art from the following detailed description, which simply illustrates various modes contemplated for carrying out the invention. As will be realized, the invention is capable of other different obvious aspects, all without departing from the invention. Accordingly, the drawings and descriptions are illustrative in nature and not restrictive.

BRIEF DESCRIPTION OF THE DRAWINGS

While the specification concludes with claims particularly pointing out and distinctly claiming the present invention it is believed that the same will be better understood from the following description, taken in conjunction with the accompanying drawings, in which:

DETAILED DESCRIPTION OF EXEMPLARY EMBODIMENTS

Reference will now be made in detail to various exemplary embodiments of the invention, several of which are also illustrated in the accompanying drawings, wherein like numerals indicate the same elements throughout the views, and numbers with the same final two digits indicate corresponding elements among embodiments.

Figure 1:
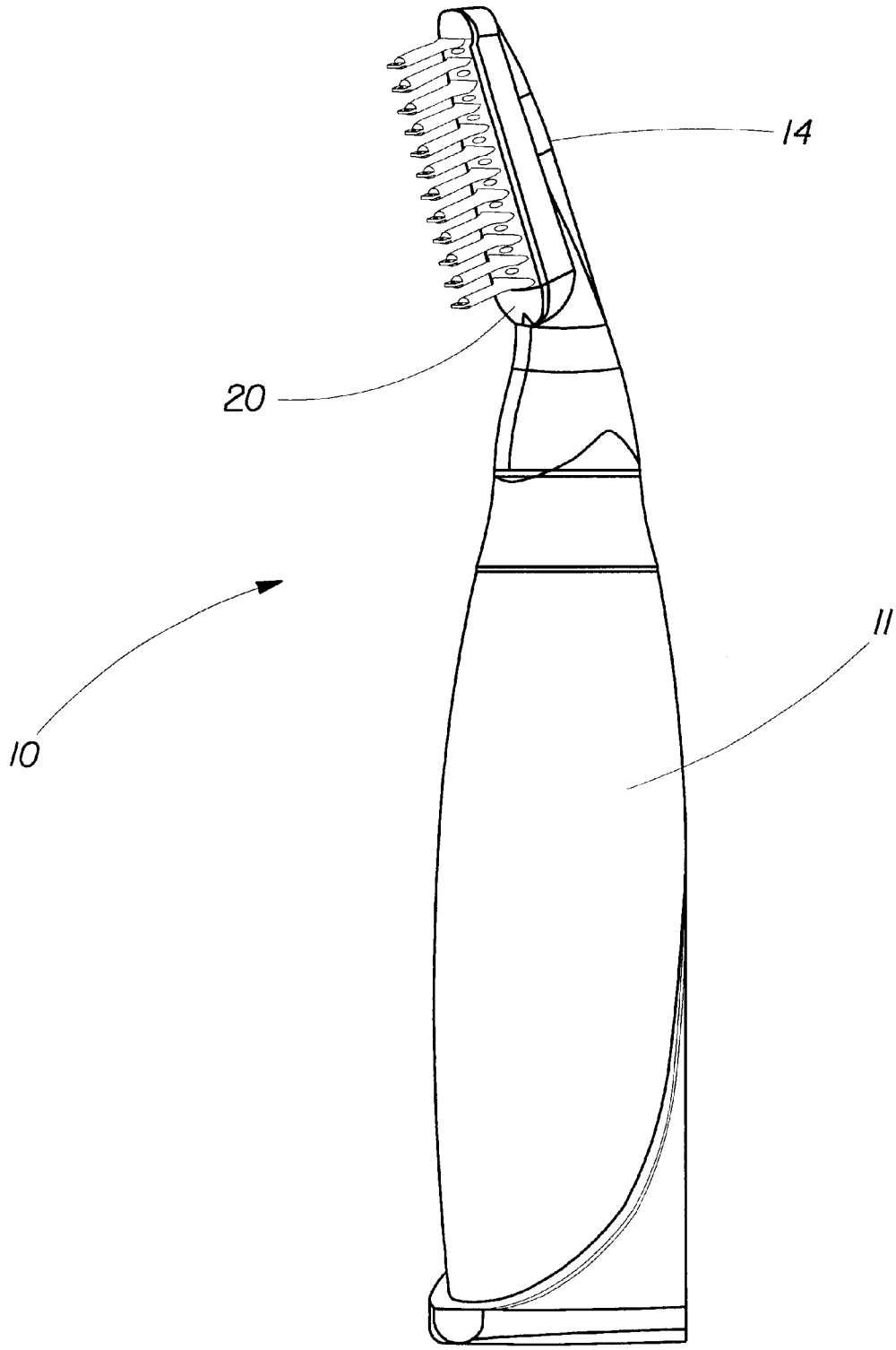
FIG. 1 depicts a perspective view of an exemplary embodiment of an applicator assembly made in accordance with the present invention.

FIG. 1 depicts a non-limiting exemplary embodiment of an applicator assembly 10 wherein an applicator 20 is assembled with an applicator housing 14 and a container 11 in the general form of a comb-like device for applying liquids to the hair of a consumer. It is contemplated that the applicator assembly 10 can be provided in a variety of forms and structures wherein a source of product to be applied is placed in fluid communication with the applicator. While the combination of an applicator with a housing (e.g. 14) and a hand held container (e.g. 11) may be used as illustrated, other arrangements may equally be substituted as well. For example, the applicator 20 may be connected to, or in fluid communication with, a hose (not shown) or other such delivery device.

Figure 1A:
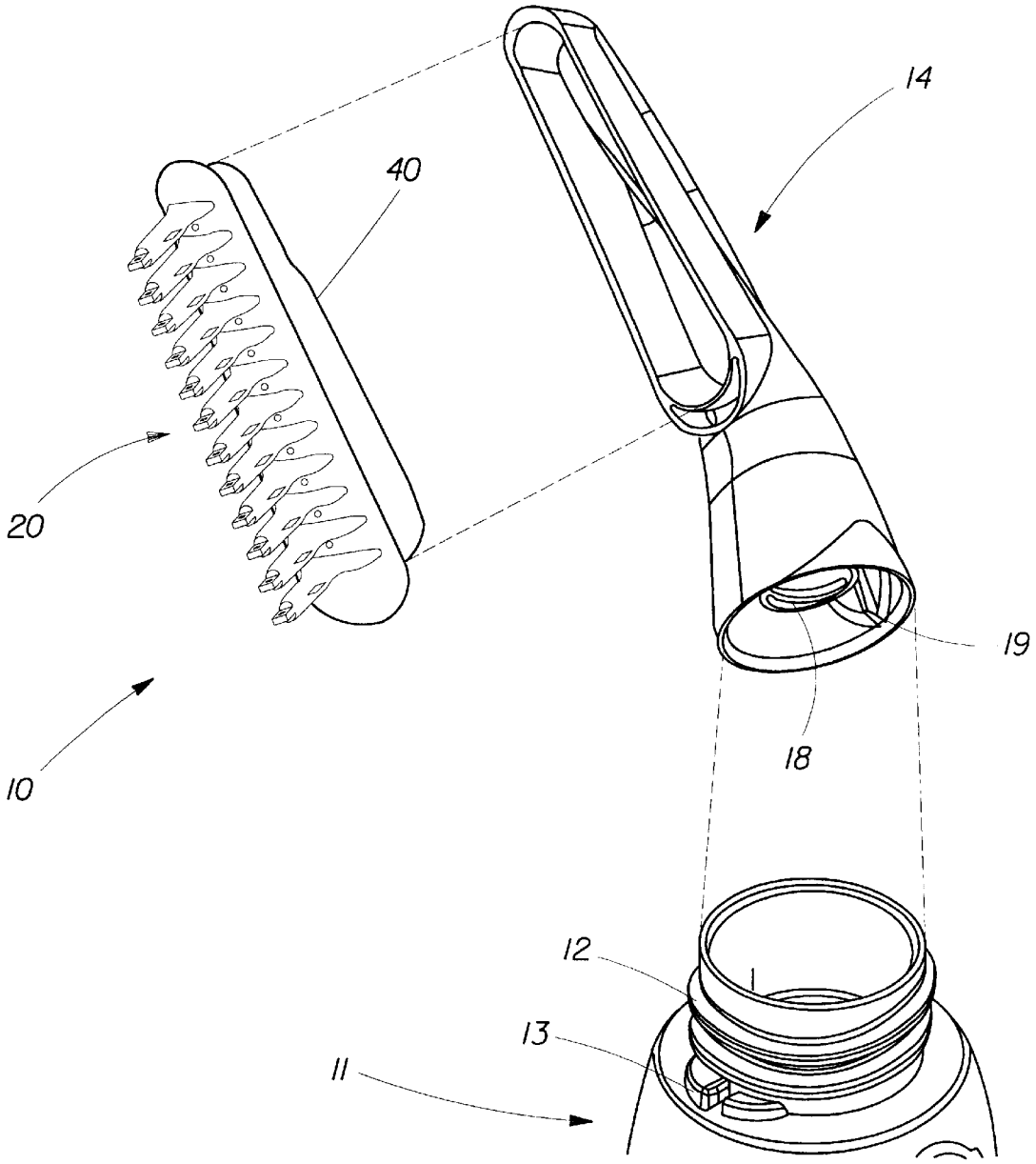
FIG. 1A depicts a partial exploded view of the applicator assembly in FIG. 1.

FIG. 1A shows the applicator 20 detached from the applicator housing 14 and the applicator housing 14 detached from the container 11. Although many attachment arrangements can be utilized, for ease and strength of assembly, the applicator housing 14 may have a screw fitting 18 at its lower end to attach to the container's screw fitting 12. In such an example, both the container 11 and the applicator housing 14 may be joined with lugs, 13 and 19 respectively, which might snap into locking engagement with one another when the applicator housing 14 has been fully attached to (e.g., screwed into) the container 11.

Figure 1B:
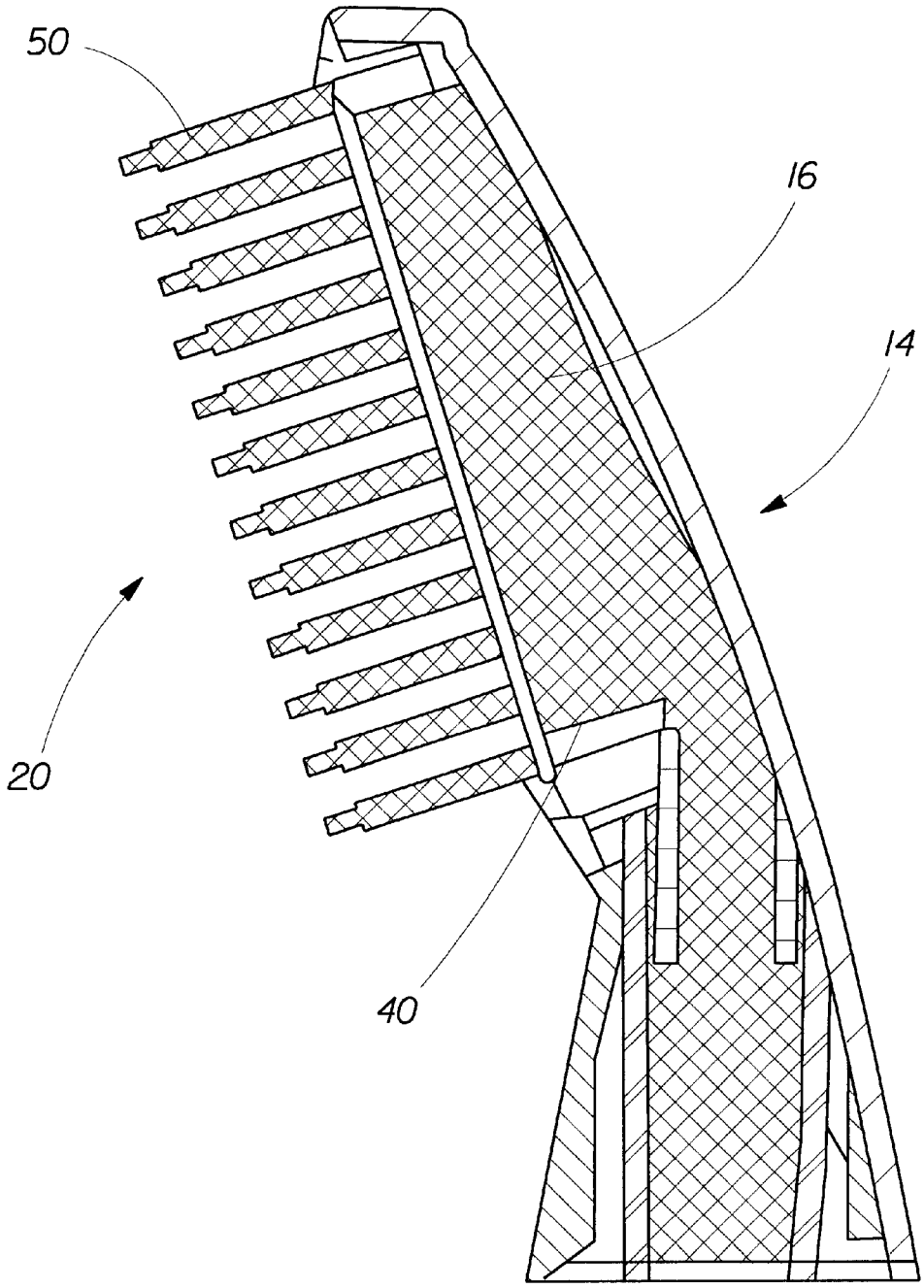
FIG. 1B depicts a partial enlarged cross sectional view of the applicator assembly in FIG. 1.

As also shown in FIG. 1A, applicator 20 has a skirt 40 which can be utilized to secure the attachment of the applicator 20 to the housing 14. As seen in FIG. 1B, once the applicator 20 is attached to the device housing 14, a fluid reservoir 16 is defined which allows fluid communication, depicted by a crosshatch pattern, between the applicator housing 14 and the applicator 20. The fluid flow will be discussed in greater detail later.

It may be appreciated that multiple applications of products with varying compositions may require using the housing 14 repeatedly with a variety of containers 11 to achieve the consumer's desired shade of hair colorant.

Figure 2:
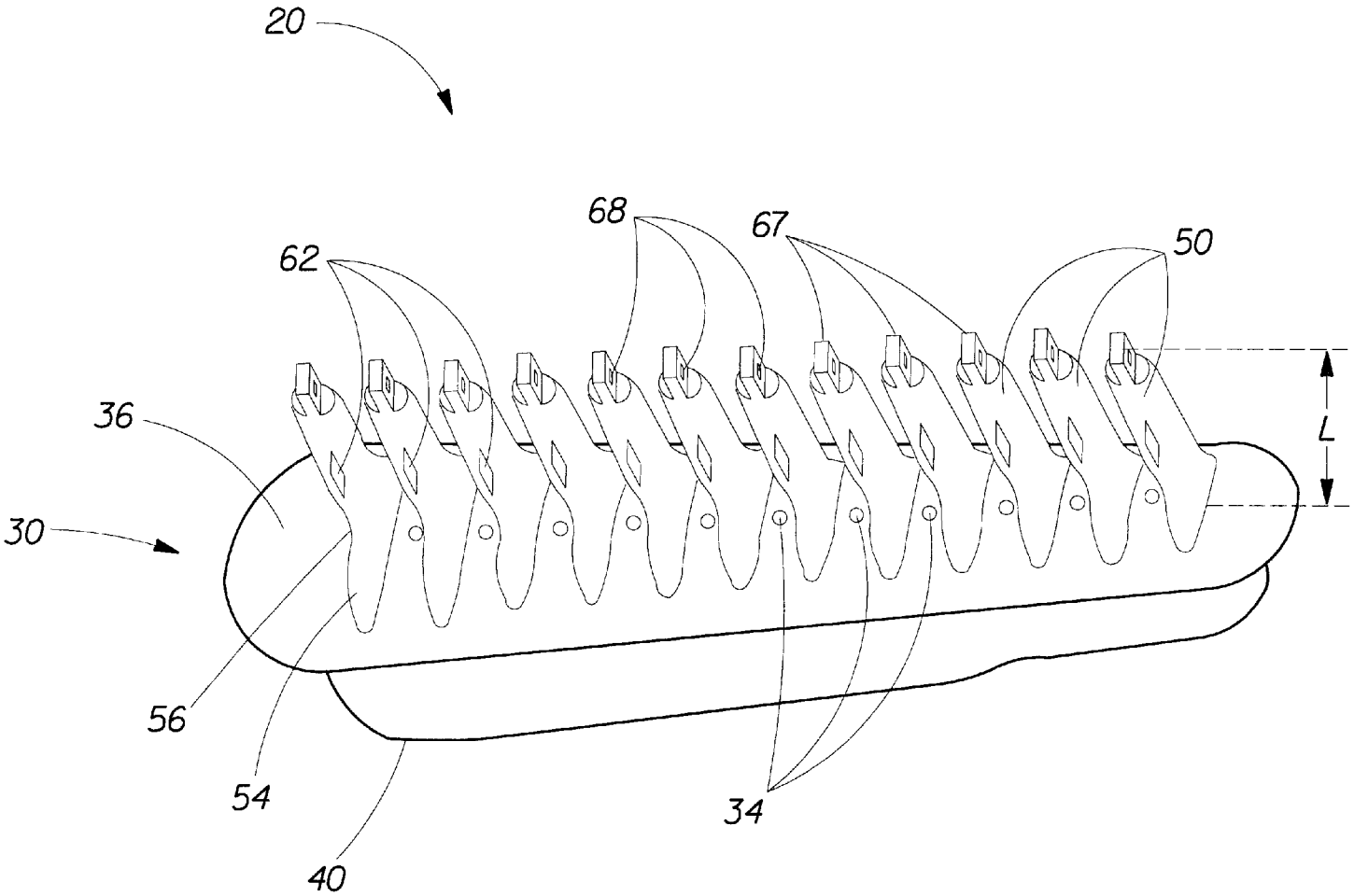
FIG. 2 depicts a perspective view of an exemplary embodiment of an applicator, made in accordance with the present invention.

FIG. 2 depicts a non-limiting exemplary embodiment of an applicator 20 in the general form of a comb-like device for applying liquids to the hair of a consumer. The illustrated applicator 20 has a base 30 with a skirt 40 extending downwardly therefrom and a plurality of tines 50 extending upwardly from the base 30. FIG. 2 further shows that the base 30 has base apertures 34 and an outer surface 36. Although the physical characteristics of the tines 50 may vary in the many embodiments of the present invention, the tines 50 similarly extend outwardly from the surface 36 of the base 30 and are generally cone shaped to facilitate ease of combing the applicator 20 through the hair of a consumer. The plurality of tines 50 each may have a bridge 67, an upper aperture 68, lower apertures 62, and a fin shaped bottom portion 54 with a shoulder portion 56 defining the upper or distal portions of the fin 54.

Figure 3:
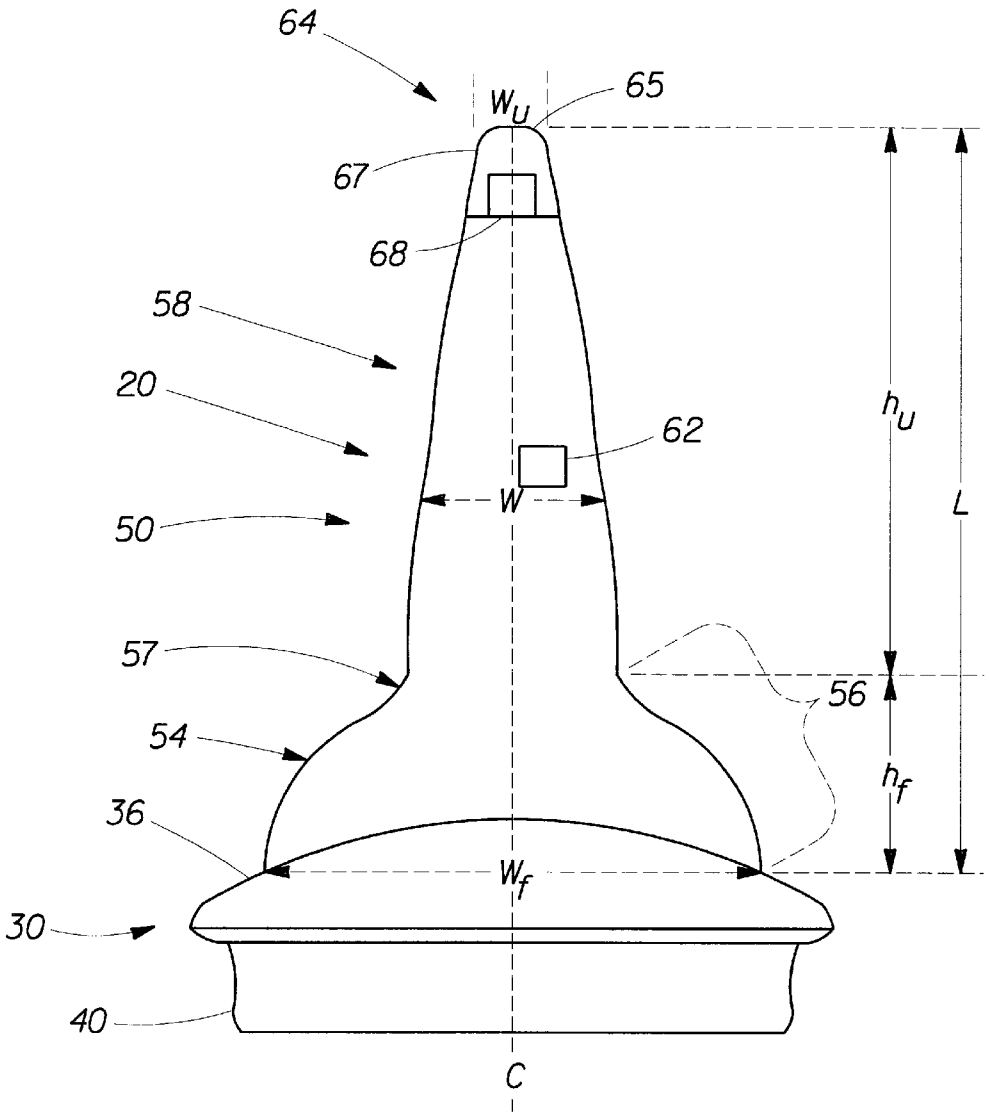
FIG. 3 depicts an end elevational view of the applicator in FIG. 2.

FIG. 3 shows a non-limiting exemplary embodiment of a tine 50, along with the base 30 of an applicator 20, in greater detail. Each tine 50 of this example includes a fin 54 adjacent its proximal end that is connected adjacent to the outer surface 36 of the base 30, and an upper portion 58. The top part of the upper portion 58 of the tine 50 will be described as tip 64 and comprises the upper end of the upper portion 58, and might extend down near the fin 54 but usually will not include the part of the upper portion connected to the fin 54. The tine 50 has a height or longitudinal length "L" measured from the lowermost point of the fin 54 to the uppermost point, or a distal end 65, of the tine tip 64. The tine 50 also has a width "W" measured at 50% of the overall length L of the tine 50. The relevance of the length L and the width W dimensions will be discussed in greater detail below. The fin section 54 has a height "$h_f$" as measured from the lowermost to higher most point of the fin 54. The fin also has a width $W_f$ measured across the lowermost points of fin 54. The fin width $W_f$ may vary from tine to tine in a single embodiment and certainly may vary among embodiments. The upper portion 58 of the tine 50 has a height "$h_u$" as measured at the higher most point of the fin 54 to the distal end 65 of the tine tip 64. The upper portion 58 also has a width $W_u$ measured at the distal end 65 of the tine tip 64. The heights and widths may vary from tine to tine in a single embodiment.

As seen in FIG. 3, the fin 54 generally provides a wider base section of the tine 50 which tapers in either a radius or natural line to the upper portion 58 of the tine 50. For example, the fin 54 may end at a point where the smallest radius of the tapering section exists. However, other embodiments may not have a radius, rather, they may be of a more conical shape having single or multiple angles rather than a true radius, or they may be of some other geometrical configuration or combination of geometrical configurations, as would be obvious to one skilled in the art. The fin 54 generally includes a shoulder portion 56, although the shape, size and prominence of such shoulder can vary, as will be explained. As will be appreciated, interface 57 between the shoulder 56 of the fin 54 and upper portion 58 can also vary in configuration and prominence, and may comprise a radius, an angle, or a smooth transition, or any combination of geometries.

Figure 3A:
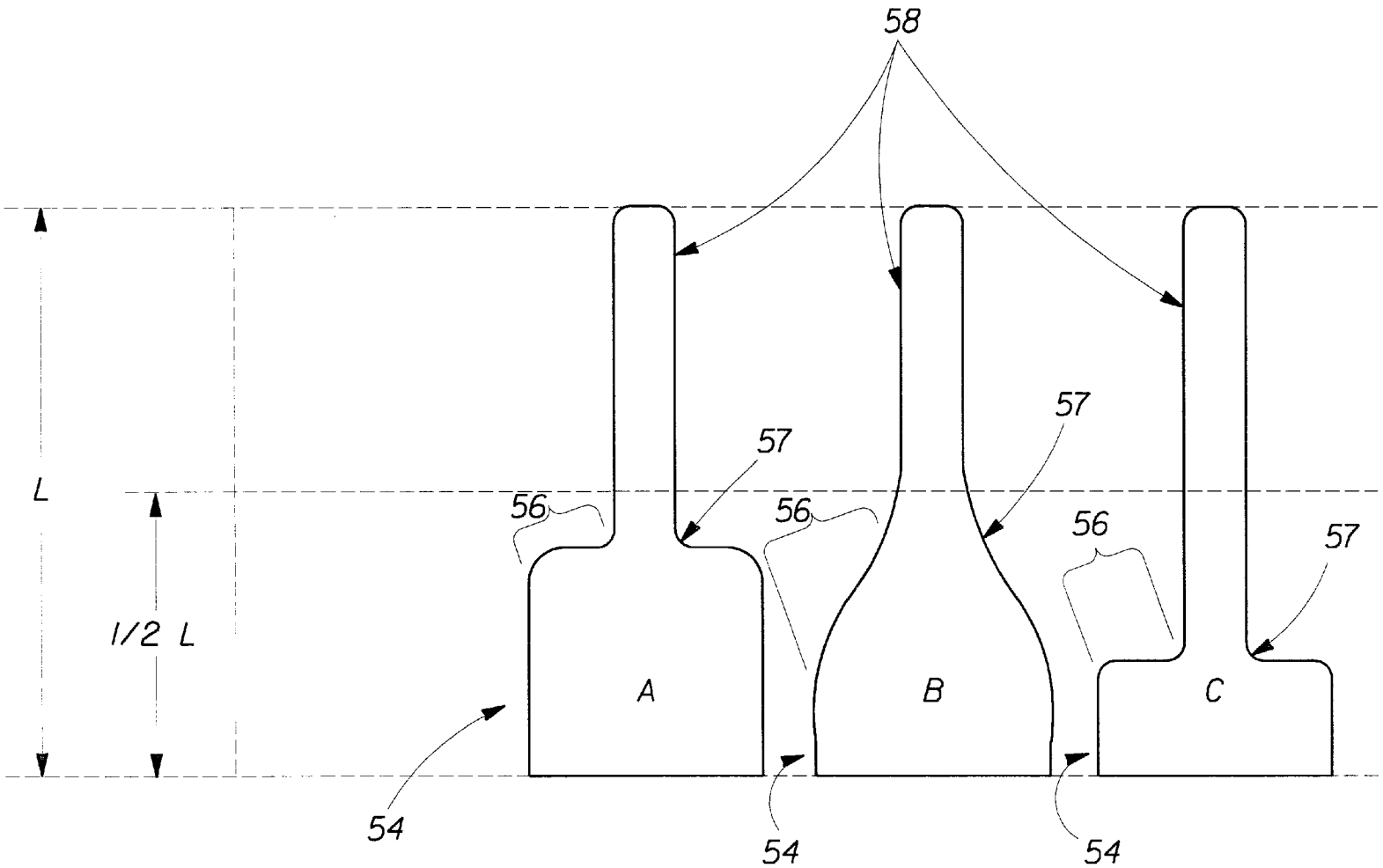
FIG. 3A depicts partial schematic views of various exemplary embodiments of tines of the applicator in FIG. 2 made in accordance with the present invention.

FIGS. 3A. shows different embodiments of the tine 50 of the current invention. Each embodiment shows the fin 54 and the upper portion 58. The fin 54, in these embodiments, extends to a length of no more than 50% of the overall length of the tine 50. Embodiment A, of FIG. 3A, shows a fin 54 that is almost 50% of the overall length of the tine 50 and that has a well defined or more visually prominent shoulder 56 located near its upper end and having a substantially horizontal component. Embodiment B shows a fin 54 that is also almost 50% of the overall length of the tine 50, but this fin 54 has a less defined large and gently curved shoulder 56. Embodiment C shows a fin 54 that is only about 20% of the overall length of the tine 50 and again that has a well defined shoulder 56. Compare these to the tine 150 depicted in FIG. 5, wherein the fin 154 is about 35% of the overall length of the tine 150, and the shoulder is conically shaped but less prominent visually than embodiment A or C of FIG. 3A. In this example, the interface 157 of shoulder 156 with the upper portion 158 comprises a ring formed at the junction of the generally conically surfaces between the upper portion 158 and the fin 154. Note, where embodiments of the tine are unclear as to where the interface between the shoulder of the fin and the upper portion of the tine is located, the fin may be defined as starting where the tine increases in width by greater than 20% of the width, e.g. W in FIG. 3. It is contemplated that the interface will generally be defined by a change in angle, a radius, or other junction or intersection between the shoulder and the upper portion of a tine.

The fin 54 adds structural stability and rigidity to the tine 50 and also may help facilitate separation of hairs as they pass across the applicator 20. The fin 54 can also help distribute liquid product in use and prevent product buildup or collection—which can lead to "flicking" problems. The shoulder portion 56 can be provided with a substantially horizontal component which may also help to minimize the flicking problem.

Figure 7:
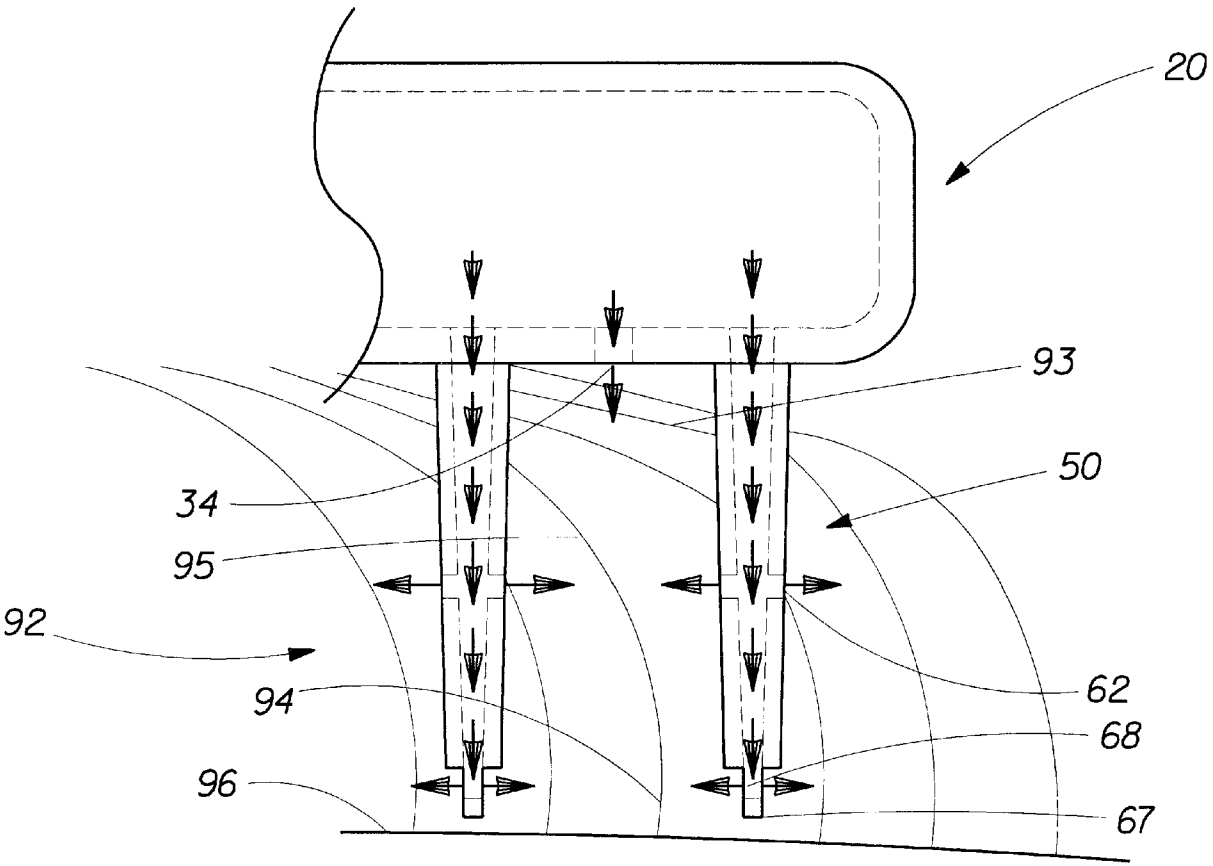
FIG. 7 depicts an enlarged partial view of an exemplary embodiment of an applicator assembly in use according to the present invention.

Also, as shown in FIG. 3, at least some of the tines 50 include a lower aperture 62 at about the mid point and/or an upper aperture 68 adjacent to the tip 64. The upper portion 58 of the tine 50 may have a plurality of lower apertures 62 located at about a mid-point between the distal end 65 of the tip 64 and the shoulder 56 and having a dispensing angle oriented to direct liquid outward and substantially perpendicular or normal to the length L of the tine 50. One lower aperture 62 would typically be on each of the oppositely disposed elongated sides of the elliptical cone shaped tine 50, that is, on the side of the tine 50 where the width W is measured and generally directed toward the space between adjacent tines 50. Also, at its tip 64, the tine 50 has an upper aperture 68 and may also have a flange or bridge 67. The upper aperture 68 provides a liquid outlet having a dispensing angle directed substantially parallel to the length L. In this particular example, the upper aperture 68 is also located generally along the center line C of the tine 50, although its location could be varied widely. The bridge 67 is illustrated with a width $W_u$ and is defined by any portion of the tine 50 that extends beyond the upper aperture 68. The bridge 67 can help to divert flow in a radially outward direction, as seen in FIG. 7, from the upper aperture 68.

Figure 4:
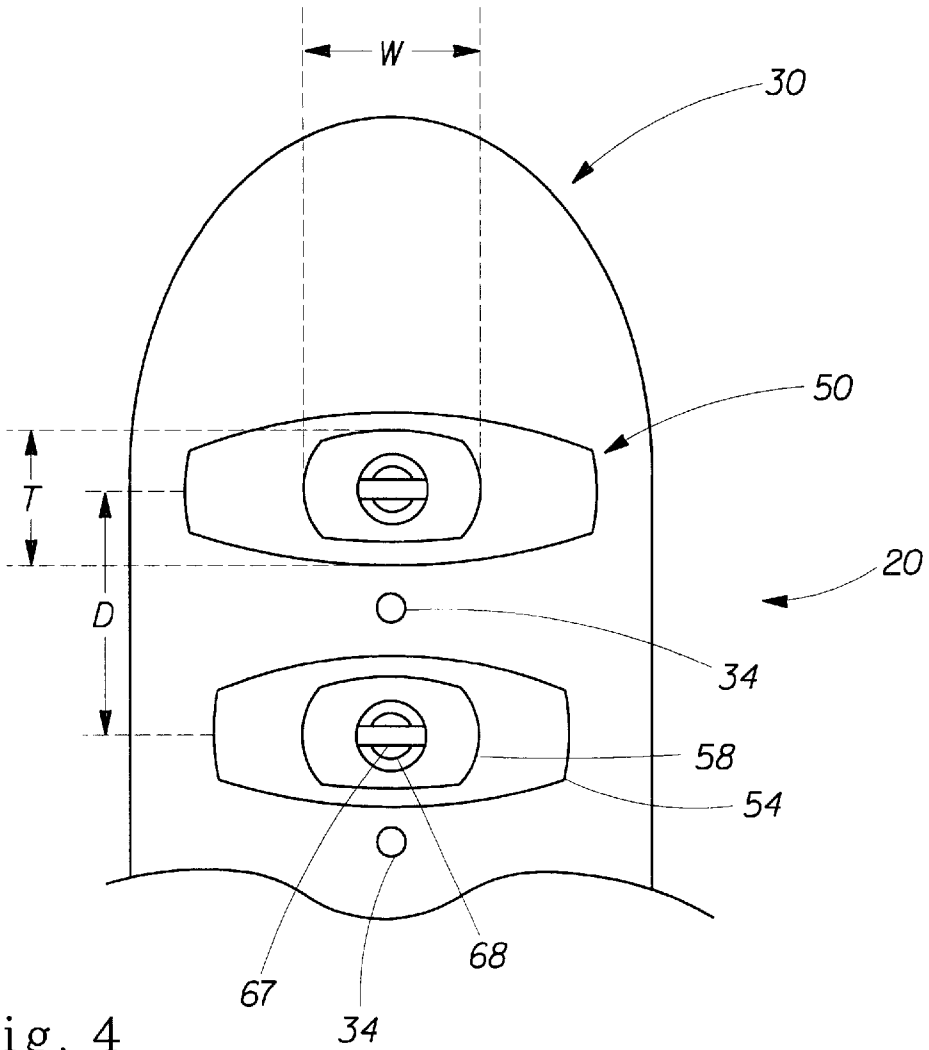
FIG. 4 depicts a partial top planar view of the applicator in FIG. 2.

FIG. 4 discloses one embodiment of an applicator 20 from a partial top planar view. Each tine 50 has a thickness T measured across its upper portion 58 just above its fin 54 and adjacent the width W. Each of the tines 50 are separated by a distance D from tine center to tine center. The further relevance of the thickness T and the distance D will also be discussed in greater detail below. The base 30 might also have dispersing apertures 34 between some or all of the adjacent tines 50. It should be understood that these base apertures 34, their number, size and location could vary among applications. In some situations, they might not be present at all. Also shown in FIG. 4 is the bridge 67 and the upper aperture 68.

As shown in FIG. 3, the lower apertures 62 might be staggered or located off center of the respective side of the tine 50 and positioned toward opposite narrow ends, that is, toward opposite sides of the tine 50 where the thickness (e.g. T in FIG. 4) is measured. Molding manufacturing, as known and as may be tuned by one skilled in the art, may be simplified by having staggered apertures because the pins used to make the apertures on each side of the tine 50 do not interfere with each other.

Figure 5:
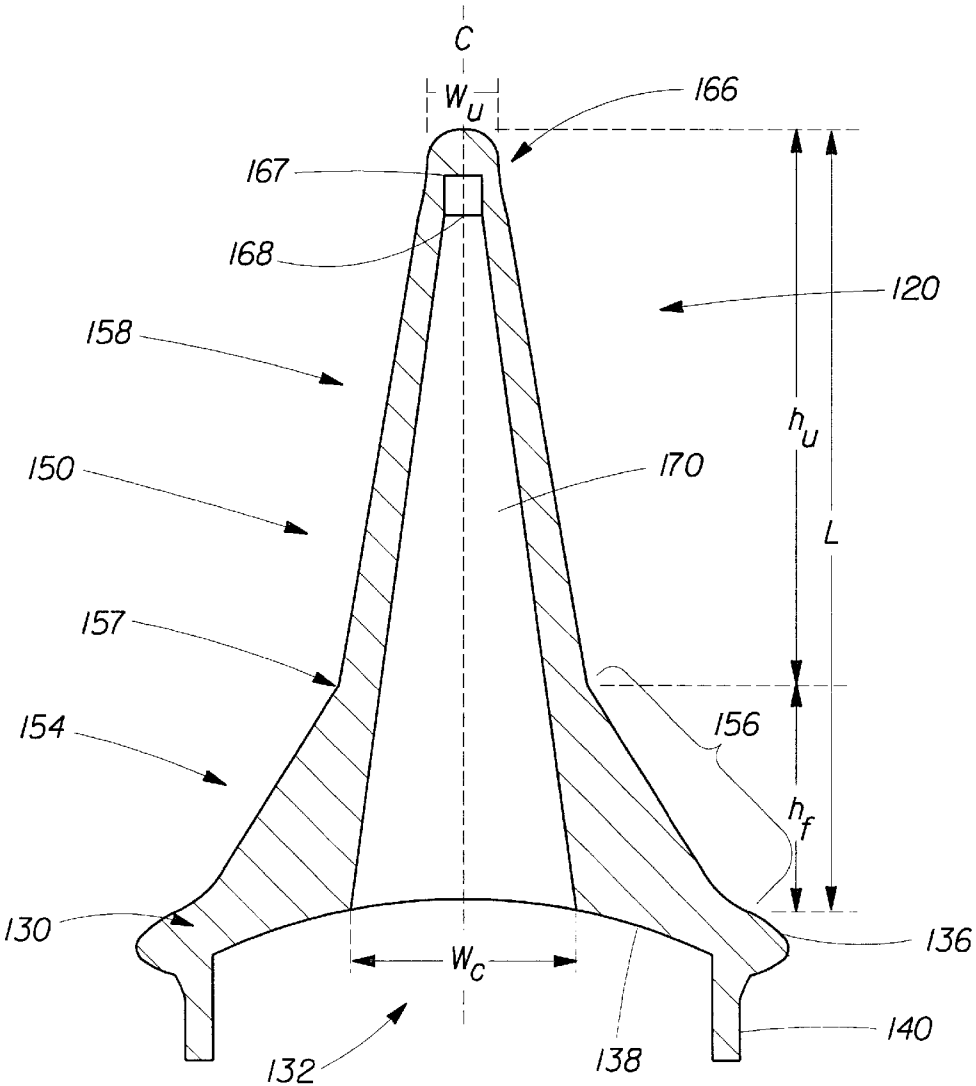
FIG. 5 depicts a cross sectional view of an exemplary embodiment of another applicator of the present invention.

FIG. 5 shows another non-limiting exemplary embodiment of a tine 150, along with the base 130 having a skirt 140, in cross-section. The base 130 might also be provided with an elongated inner surface 138. The skirt 140 extends downwardly, and slightly recessed within the perimeter of an inner surface 138 and is offset inwardly of the perimeter of the base 130 to allow the applicator 120 to seat with an applicator housing. The inner surface 138 and the skirt 140 generally define a liquid distribution cavity 132.

The base 130 also has a outer surface 136. In one embodiment, the outer surface 136 may be convex. Tines 150 extend upwardly from the outer surface 136. The shape of the tines 150 is generally like an elliptical cone, as seen in FIG. 4, or triangular, as seen in FIG. 3, although the shape of tines for any particular application could vary widely. The position of the tines 150 on the base 130 could be random, staggered, or arranged in a single line for application of liquid such as hair color, conditioner or other treatment in a combing-like manner.

Also shown in FIG. 5, at least some of the tines 150 of applicator 120, which include a lower aperture (e.g. 62 in FIG. 3) and/or an upper aperture 168 from which fluid may be dispensed, will include one or more channels 170 that may be tapered or slightly cone shaped which extend from adjacent the inner surface 138 to at least one such aperture. In this illustrated example, the upper aperture 168 is the outlet end of the channel 170 which provides fluid communication from the base cavity 132 to the upper aperture 168. At the inner surface 138 of the base 130 the channel 170 has a width $W_c$.

In some embodiments of the invention, the lower aperture and the upper aperture may have a dispensing outlet area which are approximately equal. The term "area" is used here to accommodate dispensing apertures of all shapes and types, including embodiments allowing for the apertures to be round, slotted, square, slit type, always-open bores, self-sealing openings, or of any other manufactured shape or method. It should be noted, however, that the base apertures might advantageously be about ½ (0.5) to about ¾ (0.75) of the area or size of the lower aperture or of the upper aperture to provide delivery of a proper ratio of product through each aperture during use, thereby providing a more predictable and/or even coating of the product. Also note that the base apertures, as seen in FIG. 4, extend through the base, that is, they extend from the base inner surface to the base outer surface. Therefore, the base apertures are in direct fluid communication with the fluid reservoir.

Figure 6A:
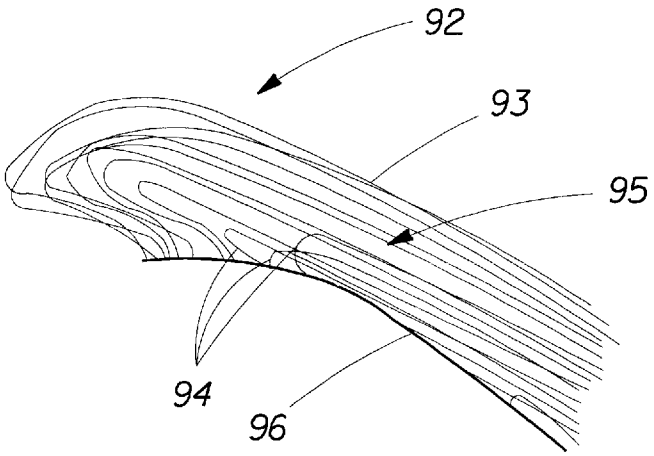
FIG. 6A depicts a partial cross sectional view of a consumer's hair.
Figure 6:
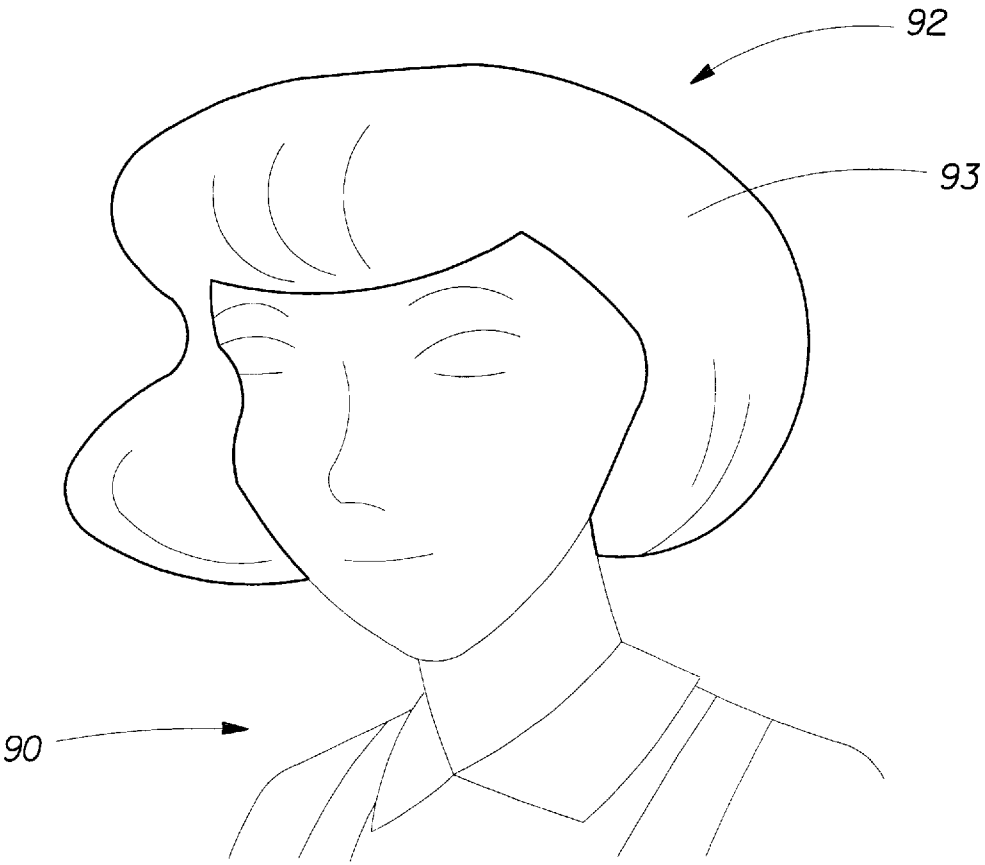
FIG. 6 depicts a partial schematic view of a consumer.

To illustrate the use of the applicator, in accordance with the invention, providing a more predictable and/or even coating of the product consider FIGS. 6, 6A, and 7. FIG. 6 schematically depicts a consumer 90. The consumer's hair 92 that is most likely seen by the consumer 90 and others is called the surface 93. However, whether because the consumer 90 wears a different hair style or because the hair grows or just because of consumer preference, the hair surface 93 is not the only area needed to be treated. As seen in FIG. 6A, typically, the consumer 90 expects a predictable and/or even coating of the product to the surface 93, the roots 94, and the bulk 95 of the hair 92, without any negative impact to the scalp 96. The roots 94 of the hair 92 are that length of hair 92 closest to the scalp 96 and is normally measured from the scalp 96 to about one inch (25 mm) in length. The bulk 95 of the hair 92 is that area of hair 92 between the root 94 and the surface 93.

The applicator of the current invention provides the improved coating and comfort desired by consumers. For example, as seen in the embodiment of FIG. 1 and depicted in FIG. 7, the product delivered to the base apertures 34 coat the surface 93 of the hair 92 allowing the consumer 90 to see where the product has been applied, thus allowing a more even application of the product. The product delivered by the upper apertures 68 applies product to the roots 94 of the hair 92 for a complete coloring. Further, the product dispensed through the lower apertures 62 also provides good lubrication to the tines 50 allowing for easy movement of the applicator 20 through the bulk 95 of the hair 92. Other embodiments of the current invention may include arrangements having only lower apertures and base apertures, having only upper apertures and base apertures, and having only upper apertures and lower apertures. Other embodiments may also use any variety of aperture sizes.

FIG. 4 shows the tines 50 as being separated by a predetermined distance D that might be about 1 to 1.5 times the width W of each individual tine. In one exemplary embodiment of the invention having a comb-like configuration, the width W of the tine 50 might range from about 2.8 mm to about 5.7 mm and the distance D could range from 2.8 mm to 8.5 mm. The thickness T, of the tines 50 might range from about 1.3 mm to about 2.7 mm.

Other dimensions are shown in FIG. 3. For example, the width $W_f$ of the tines 50 at the fin 54 that is adjacent to the inner surface 38 of the base 30 might range from about 8 mm to about 16 mm, and the width $W_u$ of the tines 50 at the distal end of the tip 64 might range in width from about 1.3 mm to about 2.7 mm. Moreover, the total length L of the tines 50 might range from about 10 mm to about 20 mm, wherein the upper portion 58, defined by distance $h_u$, might range in length from about 5.1 mm to about 16.0 mm, with the fin 54, defined by distance $h_f$, ranging from about 2.0 mm to about 9.9 mm. The distance $h_f$ will be less than the distance $h_u$ and may be a minimum of 20% of the tine length L. Also, as seen in FIG. 5, the channel 70 may preferably range, at the tine tip 64, or the upper aperture 68 diameter, from about 0.8 mm to about 1.7 mm, and, at the inner surface 138 the channel 70 may preferably range from about 1.1 mm to about 2.3 mm. The spacings and ranges could vary by particular application, product to be dispensed, or preferences as will be understood by one skilled in the art.

Figure 8:
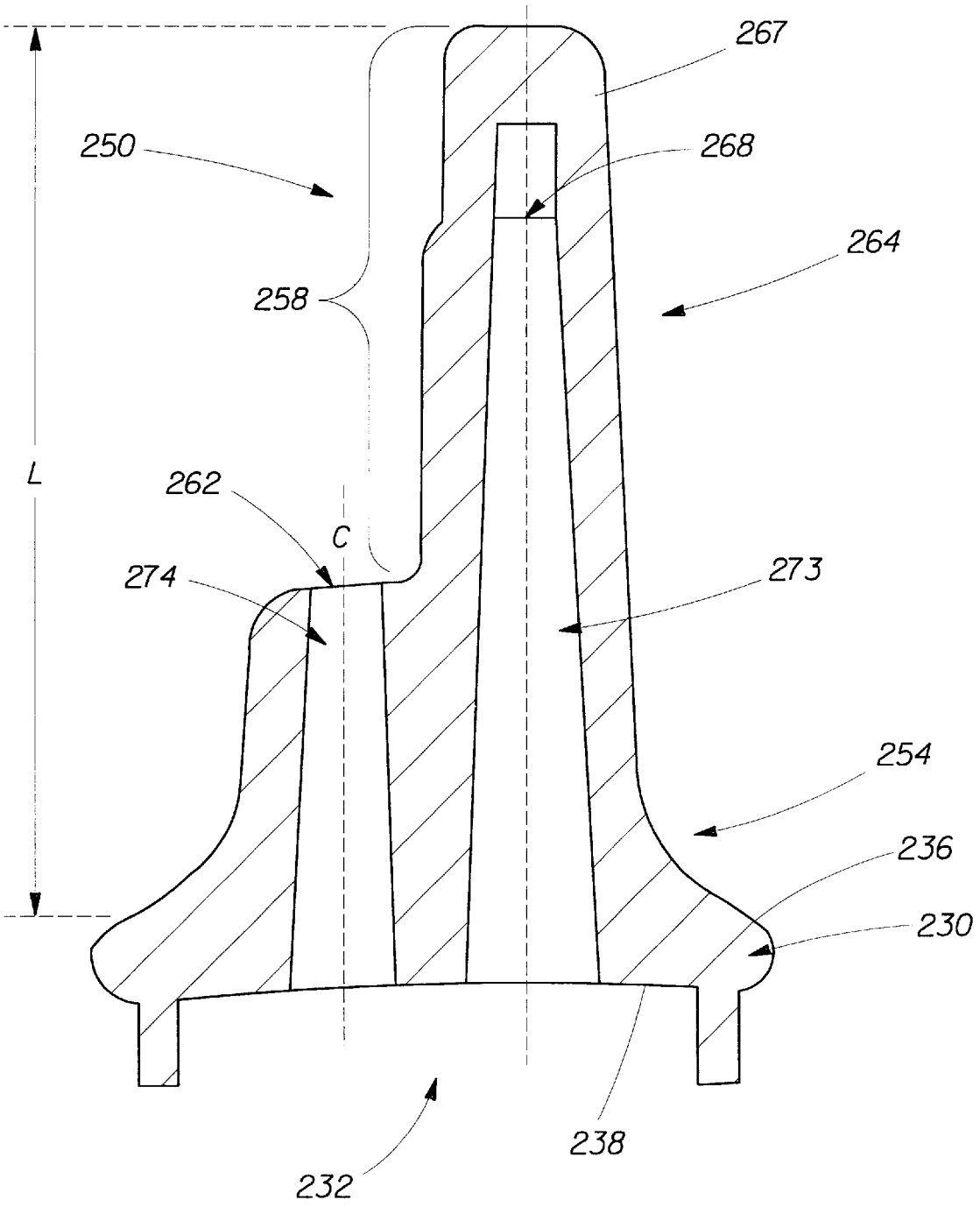
FIG. 8 depicts a cross sectional view similar to that of FIG. 5 of an alternative embodiment of the tines in an applicator made in accordance with the present invention.
Figure 10:
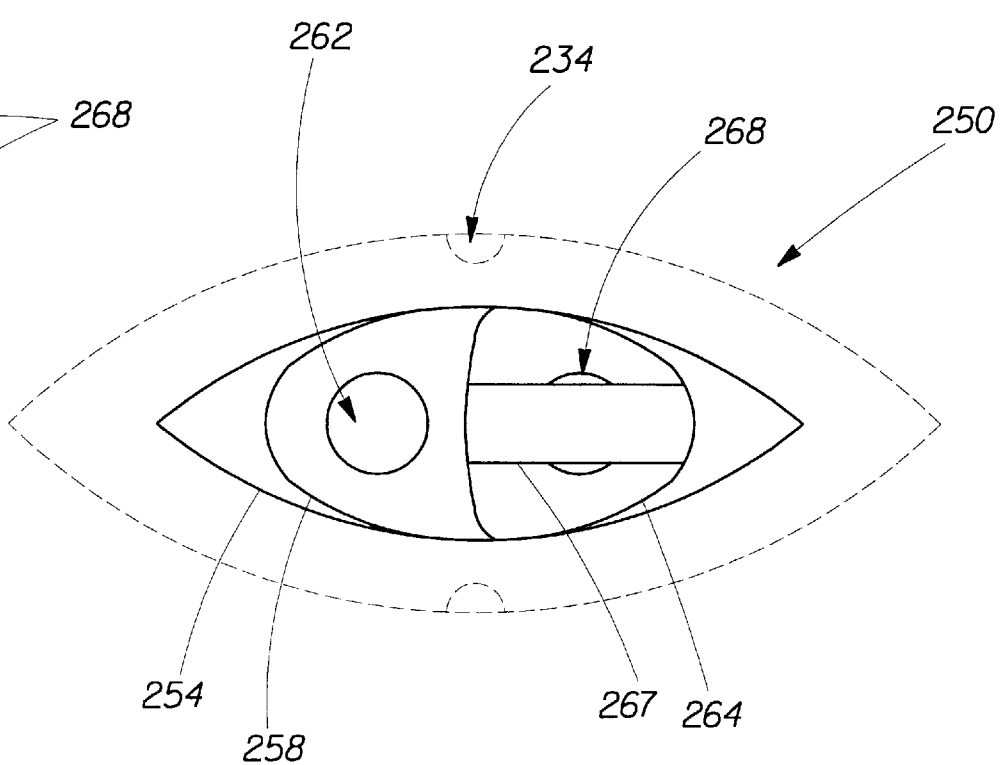
FIG. 10 depicts an enlarged, partially cut-out top plan view of a tine of FIG. 8.
Figure 9:
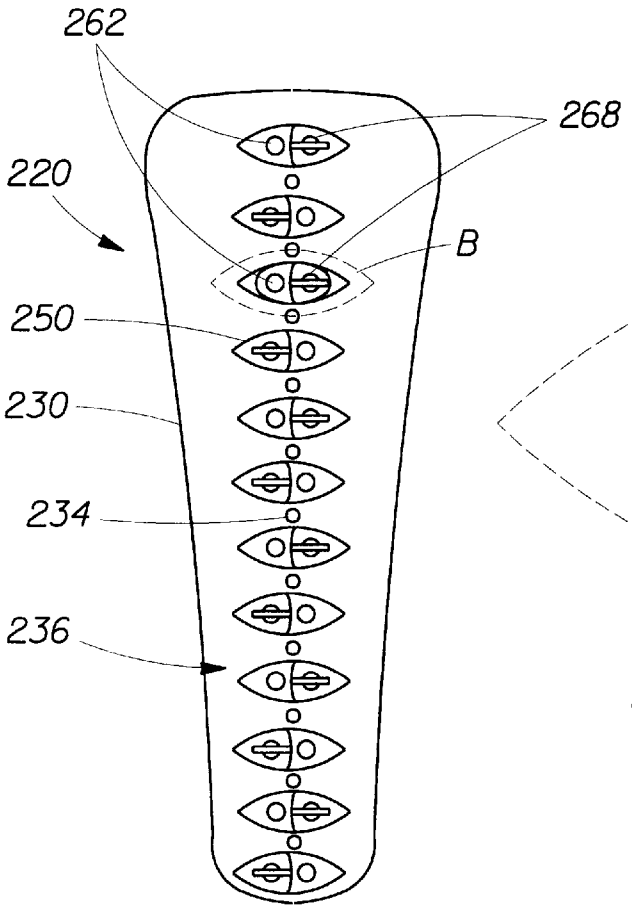
FIG. 9 depicts a top planar view of an applicator of the present invention including tines as depicted in FIG. 8.

FIG. 8–FIG. 10 show different embodiments of the tines 250 in an applicator 220 made in accordance herewith. As viewed in FIG. 8, the tine 250 has multiple channels; particularly, a first channel 273 and a second channel 274. In one embodiment, these channels are tapered from wider to narrower as they extend toward the tip 264. This allows, for example, ease in removing the molding pins used to form the channels during injection molding manufacturing. The tip 264 is substantially the same configuration for the tine 250 as in previous embodiments discussed. The first channel 273 extends from the inner surface 238 to the upper aperture 268 and provides fluid communication with the base cavity 232 similar to previous embodiments discussed. A second channel 274 runs adjacent to the first channel 273. The second channel 274 extends from the inner surface 238 to the lower aperture 262. However, instead of a lower aperture having a dispensing angle directed from the side of the tine, the lower aperture 262 has a dispensing angle directed upwardly and is merely a continuation of the second channel 274. This can make manufacturing easier because, as known by those skilled in the art, pins may be used instead of shut-offs. Shut-offs create metal to metal contact which can cause increased cost and decreased mold life. Pins tend to wear less because the metal to metal contact is minimized. Typically, pins are also easier to replace and more readily available.

FIG. 9 shows a top plan view of such a dual channel embodiment of the applicator 220. The lower apertures 262 and the upper apertures 268 are on alternate sides of each adjacent tine 250. By this staggered method, the lower aperture 262 on every other tine 250 is directed toward the leading edge of the tine 250. The leading edge of the tine 250 is the surface of the tine 250 pointed in the direction of the combing or movement of the applicator 220. Thus, fluid or product from the lower aperture 262 is also directed toward the leading edge on every other tine 250. This staggered configuration allows for multiple direction application and consistent flow of product no matter which direction the consumer combs their hair. Since the lower aperture lubricates the bulk of the hair, the comfort to the consumer when combing is increased by the staggered design.

FIG. 10 illustrates an enlarged view of detail "B" from FIG. 9. As shown in FIG. 10, and as may be seen by comparison in FIG. 7, the bridge 267 increases the comfort to the scalp 96 of the consumer while directing product flow in a more horizontal direction toward the roots 94 instead of directly into the scalp 96. The bridge 267 is an arch-like extension beyond the upper aperture 268. The upper aperture 268 may be made by piercing a wire through the tines 250 after the applicator is formed or by using shut-offs as known to those skilled in the art. As fluid is delivered by the upper aperture 268, the bridge 267 deflects the fluid from its longitudinal flow along the length of the tine 250 to a direction somewhat perpendicular to the length. Thus, the flow is directed toward the roots 94 of the consumer's hair 92 instead of toward the consumer's scalp 96. The bridge 267, also has rounded corners (also best depicted as 67 in FIG. 7) that increases the comfort to the scalp 96 of the consumer. Thus FIG. 7 shows how, in various embodiments having a bridge, the bridge disrupts fluid flow from the upper aperture. As product exits the upper aperture, the bridge, as stated, disrupts the flow and redirects the flow substantially perpendicular to the tine length. Again, this disruption allows more product to flow to the root of the hair and less product is directed to the scalp of the consumer.

Dimensionally, and as seen in FIG. 8, the total length L of the tines 250 in a comb-like arrangement may range from about 10 mm to about 20 mm, wherein the upper portion 258 might range in length from about 5.1 mm to about 16.0 mm. Other dimensions might be similar to those disclosed with previous embodiments.

In yet an additional embodiment of the current invention, the fin portion of the tines may generally be more rigid in nature than the tip of the upper portion. In particular, the fin may be formed of stronger or more rigid material, reinforced, or made thicker than the otherwise more compliant, compressible, thinner, less strong and substantially more flexible tip, by structural design. Accordingly, the fin of the tine may be substantially rigid to provide support to the flexible tip and may facilitate application of the product.

Figure 11:
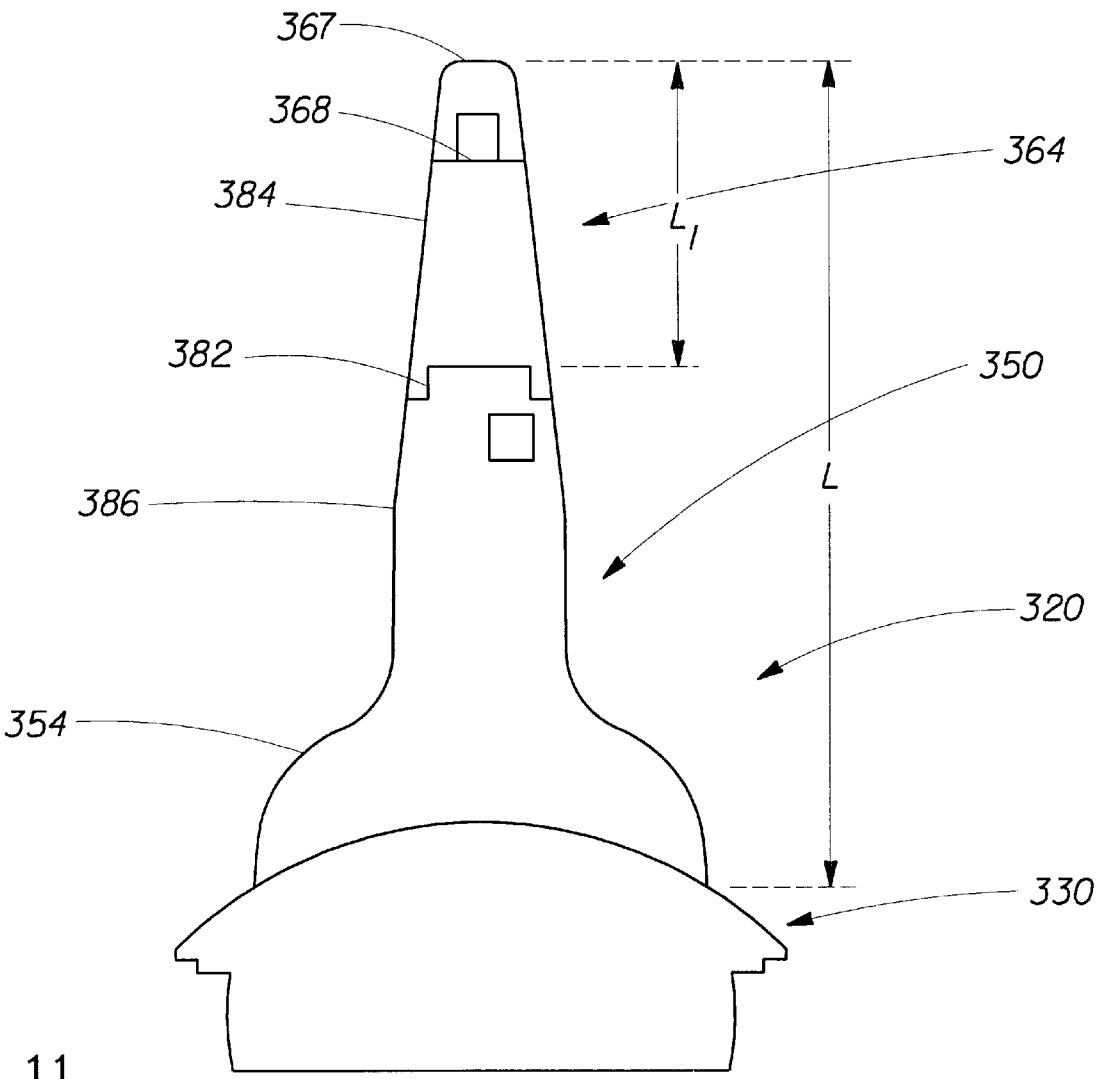
FIG. 11 depicts an end elevational view of the applicator of FIG. 2 in another exemplary embodiment of an applicator in accordance with the present invention.

FIG. 11 depicts such an embodiment of the present invention having a rigid section 386 and a flexible section 384. The place on a tine 350 where the rigid section 386 stops and the flexible section 384 begins is called an interface 382. The flexible upper section 384 of the tine 350 is illustrated as having a flexible length $L_1$, and may be generally soft to the touch, compliant and compressible. The flexible length $L_1$ may vary in location in different embodiments but will generally be where the interface 382 is above the fin 354 and, in embodiments having a bridge 367, below the bridge 367. In a comb-like example, the flexible length $L_1$ might range from about 3.3 mm to about 6.7 mm, and the balance of the tine 350 would be considered the rigid section 386. The characteristics of such embodiments may provide the tine 350 with a unique combination of good scalp contact while also providing a pleasant feel upon contact.

Additionally, because the flexible section 384 facilitates intimate contact with the scalp during use, it may also help optimally disperse the product and optimize the amount of product used by acting as a valving feature. The substantially flexible section may increase the effective outlet opening size of said apertures to a predetermined size during application. This is especially useful if the upper aperture 368 is a slit or self-sealing opening. Contact of the soft bridge 367 with the consumer's scalp will cause the flexible section 384 of the tine 350 to flex, allowing unobstructed flow of product through the open valve or upper aperture 368. Once the flexible section 384 loses contact with the scalp, the valve will close as the flexible section 384 returns to its normal position.

In some embodiments of the invention, as shown in FIG. 11, the tines 350 could be more conveniently or simply manufactured from different material constituents, such as a more rigid material for the rigid section 386, and a relatively soft, compliant and compressible material for the flexible section 384. Such a multiple material design may give the broadest range of structural features that would need to be taken into account such as wall thickness, length, width, and geometric configuration. In other embodiments, it is feasible to manufacture the tines 350 from a single material such as polypropylene, polyethylene, thermoplastic elastomer or other material having the characteristics of a rigid section 386 adjacent the base 330 and a flexible section 384 adjacent to tip 364 as a result of the manufacturing process of locally controlling heat, pressure and other such variables known to those skilled in the art.

In a non-limiting exemplary embodiment of the present invention that may apply to single channel, dual channel or any other tine configuration, the tines could be manufactured using a two-shot injection molding manufacturing process. In particular, the fin of the tines might be manufactured as a single integrated component with the base due to the desired substantially rigid nature of both structures. Manufacturing this integrated component might comprise the first shot in the two-shot manufacturing process. A suitable material may include polypropylene SM-6150 such as available from Montell, although, other thermoplastic materials such as polypropylene, polyethylene, polyester, polycarbonate or polyvinylchloride would also be suitable for this purpose. In an exemplary device for scalp applications, the selection of such a material may include materials having a flexible modulus of about 50,000 psi to about 200,000 psi, wherein flexible modulus is defined as the ratio of stress to corresponding strain within an elastic limit.

The second shot of the contemplated two-shot manufacturing process might then comprise molding of a flexible material over the tine rigid section to create the soft, compliant and compressible flexible section Although the flexible material could be formed to the base in a variety of ways, in one embodiment of the invention, the flexible tine material is chemically bonded over the rigid section of the tine and the entire outer surface of the base due to the compatibility of the materials selected. Put another way, the chemical properties of properly selected constituent materials can allow the materials to be selectively bonded in a chemical process. Other methods of bonding the multiple-layers may include the use of adhesives or other alternative mechanical processes. As a result, the applicator is manufactured with a rigid material and then laminated or shrouded with a soft to the touch, compliant and compressible material that extends and creates the tip of the tine and perhaps extends over the fin and base outer surface.

The flexible tine can be manufactured using a soft, compliant and compressible material such as Versaflex ST1025-X, as available from GLS Corporation, however, it should also be recognized that nearly any thermoplastic elastomer, santoprene rubber or other material having similar characteristics could be substituted. Moreover, the selection of the materials should be made for ease of use and comfort to the consumer as well as for manufacturability. For example, a durometer hardness of between about 50 Shore A to about 100 Shore A may be desired wherein the durometer hardness is measured based on initial indentation of the material or indentation after a specified period of time. In an alternate embodiment for the applicator, the outer tine material could also be treated or coated with a slip agent to reduce the coefficient of friction such that the tines could be readily combed through hair and on the scalp.

Note that not all tines need to dispense fluid to the hair. Some could be for product "working" while others may be for massaging or other mechanical activities such as support for the tine structure, spacing for proper volume of product delivery, and protecting soft tip tines from being over flexed such that they fail to deliver product or break. A "working" tine, for example, merely helps to move the fluid through the hair during the combing action or may just improve the combing allowing the consumer more control of the hair. Messaging tines may be added to improve the comfort to the consumer, for instance, by being slightly longer and having a flexible tip. Also, not all tines need be the same length. Some might be shorter and less flexible for messaging, product working, skin treatment or support.

Having shown and described various embodiments of the present invention, further adaptions of the of the present invention as described herein can be accomplished by appropriate modifications by one of ordinary skill in the art without departing from the scope of the present invention. Several of these potential modifications and alternatives have been mentioned, and others will be apparent to those skilled in the art. For example, while exemplary embodiments of the inventive system have been discussed for illustrative purposes, it should be understood that the elements described may be constantly updated and improved by technological advances. Accordingly, the scope of the present invention should be considered in terms of the following claims and is understood not to be limited to the details of structure, operation or process steps as shown and described in the specification and drawings.

We claim:

1. An applicator assembly for applying liquid to hair, said applicator assembly comprising an applicator having:

(a) a base comprising a liquid distribution cavity, and (b) a plurality of tines, each having a longitudinal length extending from said base, and at least some of said tines further comprising a tip having an end located distally from said base, an enlarged fin section adjacent to said base and extending along said tine less than half way upward between said base and the distal end of said tip, and an aperture in fluid communication with said liquid distribution cavity.

2. The applicator assembly of claim 1, wherein at least some of said plurality of tines have longitudinal lengths between the distal end of their tip and said base which are different from the longitudinal length of other tines.

3. The applicator assembly of claim 1, wherein the distal end of said fin comprises a shoulder portion having a substantially horizontal component along said tine.

4. The applicator assembly of claim 1, wherein said tines having an aperture comprise a channel providing fluid communication between said aperture and said distribution cavity.

5. The applicator assembly of claim 4, wherein said channel is tapered.

6. The applicator assembly of claim 1, further comprising an applicator housing and a container in selective fluid communication with said distribution cavity.

7. The applicator assembly of claim 6, wherein said container is a manually squeezed dispensing container or an aerosol propelled dispensing container.

8. The applicator assembly of claim 1, wherein one or more of the tines having an aperture comprises a pair of apertures spaced along said longitudinal length.

9. The applicator assembly of claim 8, wherein an upper one of said pair of apertures is located adjacent the tip of the tine, and a lower one is located intermediate said tip and said shoulder.

10. The applicator assembly of claim 8, wherein said pair of apertures are oriented at different dispensing angles relative to said longitudinal length.

11. The applicator assembly of claim 10, wherein one of said apertures is oriented substantially in the same direction as the longitudinal length of the tine.

12. The applicator assembly of claim 1, wherein said base further comprises an elognated convex surface.

13. A method of applying liquid hair dyeing or liquid hair coloring products to the hair, comprising delivering said products to the hair via an applicator according to claim 1.

14. An applicator assembly for applying liquid to hair, said applicator assembly comprising an applicator having:

(a) a base comprising a liquid distribution cavity and base apertures in fluid communication with said liquid distribution cavity, and (b) a plurality of tines, each having a longitudinal length extending from said base, and at least some of said tines further comprising a tip having an end located distally from said base, and a lower aperture located intermediate to said base and said tip and being in fluid communication with said liquid distribution cavity.

15. The applicator assembly of claim 14, wherein at least some of said tines further comprise an enlarged fin section adjacent to said base and extending along said tine to a shoulder portion located less than half way upward along said longitudinal length between said base and said distal end of said tip.

16. The applicator assembly of claim 14, wherein said base apertures are located between some of the adjacent tines.

17. The applicator assembly of claim 14, wherein some of said tines further comprise upper apertures located adjacent said tip.

18. The applicator assembly of claim 14, further comprising an applicator housing and a container in selective fluid communication with said distribution cavity.

19. The applicator assembly of claim 18, wherein said container is a manually squeered dispensing container or an aerosol propelled dispensing container.

20. A method of applying liquid hair dyeing or liquid hair coloring products to the hair, comprising delivering said products to the hair via applicator according to claim 14.

21. An applicator assembly for applying liquid to hair, said applicator assembly comprising an applicator having:

(a) a base comprising a liquid distribution cavity and base apertures in fluid communication with said liquid distribution cavity, and (b) a plurality of tines, each having a longitudinal length extending from said base, and at least some of said tines further comprising a tip having an end located distally from said base, an enlarged fin section adjacent to said base and a pair of apertures spaced along said longitudinal length above said fin and being in fluid communication with said cavity.

22. The applicator assembly of claim 21, wherein said enlarged fin section of said tine extends along said tine to a shoulder portion located less than half way upward along said longitudinal length between said base and said distal end of said tip.

23. The applicator assembly of claim 21, wherein one of said apertures is oriented substantially in the same direction as the longitudinal length of the tine.

24. The applicator assembly of claim 23, where the other aperture of said pair of apertures has a dispensing angle oriented in a direction substantially normal to said longitudinal length.

25. The applicator assembly of claim 21, wherein said pair of apertures are oriented at different dispensing angles relative to said longitudinal length.

26. The applicator assembly of claim 25, wherein an upper one of said pair of apertures is located adjacent said tip of the tine, and a lower one is located intermediate said tip and said fin.

27. The applicator assembly of claim 26, wherein lower one of said apertures further comprises at least a pair of lower apertures located intermediate said distal end of said tip and said shoulder.

28. The applicator assembly of claim 27, wherein said lower apertures are located on substantially oppositely facing sides of said tine.

29. The applicator assembly of claim 21, wherein said apertures each have an effective outlet opening size, and wherein said apertures in said base have an effective outlet opening size of between about 0.5 and about 0.75 of the effective outlet opening size of said apertures in said tines.

30. The applicator assembly of claim 21, further comprising an applicator housing and a container in selective fluid communication with said distribution cavity.

31. The applicator assembly of claim 30, wherein said container is a manually squeezed dispensing container or an aerosol propelled dispensing container.

32. The applicator assembly of claim 21, wherein at least some of the tines comprise separate channels therein to provide fluid communication between one of said apertures and said cavity.

33. A method of applying liquid hair dyeing or liquid hair coloring products to the hair, comprising delivering said products to the hair via an applicator according to claim 21.

34. An applicator assembly for applying liquid to hair, said applicator assembly comprising an applicator having:

(a) a base comprising a liquid distribution cavity, and (b) a plurality of tines, each having a longitudinal length extending from said base, a tip having an end located distally from said base, a pair of spaced dispensing apertures, and at least two channels, each providing fluid communication between one of said dispensing apertures and said distribution cavity.

35. The applicator assembly of claim 34, wherein said pair of apertures are oriented at different dispensing angles relative to said longitudinal length.

36. The applicator assembly of claim 34, wherein the apertures of adjacent tines of said applicator have their apertures staggered to provide multiple direction application of liquid in a predetermined pattern.

37. The applicator assembly of claim 34, further comprising an applicator housing and a container in selective fluid communication with said distribution cavity.

38. The applicator assembly of claim 37, wherein said container is a manually squeezed dispensing container or an aerosol propelled dispensing container.

39. The applicator assembly of claim 34, wherein one of said apertures has a dispensing angle oriented substantially in the same direction as the longitudinal length of the tine.

40. A method of applying liquid hair dyeing or liquid hair coloring products to the hair, comprising delivering said products to the hair via an applicator according to claim 34.

41. An applicator assembly for applying liquid to hair, said applicator assembly comprising an applicator having:

(a) a base comprising a liquid distribution cavity, and (b) a plurality of tines, each having a longitudinal length extending from said base, and at least some of said tines further comprising a tip having an end located distally from said base, an enlarged fin section adjacent to said base, and an aperture in fluid communication with said liquid distribution cavity, wherein at least some of said tines are configured to provide a substantially rigid lower section and a substantially flexible upper section adjacent said tip.

42. The applicator assembly of claim 41, further comprising an applicator housing and a container in selective fluid communication with said distribution cavity.

43. The applicator assembly of claim 42, wherein said container is a manually squeezed dispensing container or an aerosol propelled dispensing container.

44. The applicator assembly of claim 41, wherein said substantially rigid lower section has a modulus of about 50,000 psi to about 200,000 psi and said substantially flexible section has a durometer of between about 50 Shore A to about 100 Shore A.

45. The applicator assembly of claim 41, wherein said substantially flexible section comprises a softer material than said substantially rigid lower section.

46. The applicator assembly of claim 45, wherein said substantially flexible section comprises a thermoplastic elastomer.

47. A method of applying liquid hair dyeing or liquid hair coloring products to the hair, comprising delivering said products to the hair via an applicator according to claim 41.

* * * * *

UNITED STATES PATENT AND TRADEMARK OFFICE

CERTIFICATE OF CORRECTION

PATENT NO. : 6,457,476 B1
DATED : October 1, 2002
INVENTOR(S) : S.J. Elmer et al.

It is certified that error appears in the above-identified patent and that said Letters Patent is hereby corrected as shown below:

Title page,
Item [57], ABSTRACT,
Line 2, “further base” should read -- further has a base --.
Line 7, “sections” should read -- section --.

Column 11,
Line 28, “squeered” should read -- squeezed --.

Signed and Sealed this

Twenty-second Day of March, 2005

JON W. DUDAS
*Director of the United States Patent and Trademark Office*